United States Patent [19]

Hansmann

[11] Patent Number: 4,961,501

[45] Date of Patent: Oct. 9, 1990

[54] PACKAGE FOR A PLURALITY OF ITEMS

[75] Inventor: Otto Hansmann, Salmuenster, Fed. Rep. of Germany

[73] Assignee: Nestec S.A., Vevey, Switzerland

[21] Appl. No.: 417,890

[22] Filed: Oct. 6, 1989

[30] Foreign Application Priority Data

Oct. 5, 1988 [DE] Fed. Rep. of Germany ... 8812544[U]

[51] Int. Cl.[5] ..... B65D 5/54

[52] U.S. Cl. ..... 206/429; 206/602

[58] Field of Search ..... 206/429, 434, 192, 45.34, 206/601, 602, 604, 620, 621, 625, 628, 634

[56] References Cited

U.S. PATENT DOCUMENTS

| | | | |
|---|---|---|---|
| 2,706,076 | 4/1955 | Guyer | 206/628 |
| 3,269,639 | 8/1966 | Cash | 206/620 X |
| 3,750,937 | 8/1973 | Goodwin | 206/604 |
| 4,811,837 | 3/1989 | Larizza | 206/602 X |
| 4,865,187 | 9/1989 | Zulauf et al. | 206/634 X |

*Primary Examiner*—William I. Price

*Attorney, Agent, or Firm*—Vogt & O'Donnell

[57] ABSTRACT

A pack for a plurality of elongate articles arranged parallel to one another in a block, such as glasses, cans or the like, surrounds the block of articles such that the articles may be seen from four sides of the pack. The pack has rectangular tray-like upper and lower parts, each of which have two opposing tray wall portions extending from two opposing tray base edges. Two opposing sidewalls, which extend from opposing tray base edges adjacent the opposing tray wall portions and which have a weakened wall member, connect the upper part and the lower part. The tray wall portions define a first pair of opposed openings through which the articles may be seen, and the opposing connecting sidewalls are configured to define openings which are adjacent the first pair of opposed openings so that the articles may be seen from four sides of the pack.

5 Claims, 1 Drawing Sheet

PACKAGE FOR A PLURALITY OF ITEMS

BACKGROUND OF THE INVENTION

This invention relates to a pack for a plurality of elongate articles to be arranged parallel to one another in a block. Packs of this type provide for the transport of a plurality of articles accommodated therein and also facilitate the display position without the articles having to be individually removed from the pack.

FIG. 1 shows one example of a conventional folding box of cardboard. The pack is used to accommodate a plurality of articles, preferably glasses, cans or the like. It comprises a rectangular tray-like upper part and a corresponding tray-like lower part which are joined together by two opposite lateral connecting walls. The pack also comprises front and rear side parts. Each of these side parts is provided with a rectangular opening extending between the two lateral connecting walls which, as an inspection window, enables the articles to be seen without allowing them to fall out. The folding box additionally comprises a perforation in the lateral connecting walls which extends near and parallel to the tray-like lower part and which makes the pack easier to tear open.

SUMMARY OF THE INVENTION

The object of the present invention is to improve the pack described at the beginning to the extent that the articles accommodated therein are more clearly visible.

The present invention relates to a pack, more especially for a plurality of elongate articles to be arranged parallel to one another in a block, such as glasses, cans or the like, having a tray-like upper part and a tray-like lower part which surround the block of articles at both ends thereof and further having two opposite connecting walls between the upper part and the lower part, in which the two connecting walls are provided at the sides extending between the upper part and the lower part with openings which are separated (only) by a weakened wall member. The openings according to the invention in the connecting walls enable the contents of the pack to be seen from all sides when the pack is in its closed position.

DESCRIPTION OF PREFERRED EMBODIMENTS

As shown in drawing FIG. 2 as described below, because the openings in each connecting wall taper towards the wall member, the observer is guided optically to the point at which the pack is to be torn open. The weakened wall section comprises on both sides a tongue which projects into the corresponding opening. Tearing open of the pack is facilitated by the tongues because they can be gripped with the thumb or a finger. Tearing open of the pack is also facilitated by a perforated line in each of the two connecting walls which extends substantially parallel to the upper and lower part in which the perforated line extends transversely through the weakened wall member, preferably through the narrowest part thereof.

Examples of embodiments of the invention are described in detail with reference to the accompanying drawings.

DETAILED DESCRIPTION OF THE DRAWINGS

Figure 1:
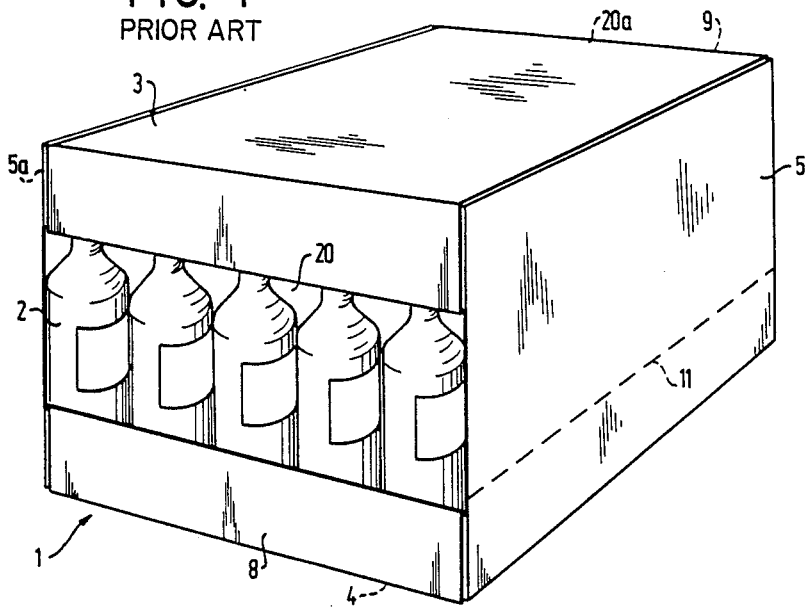
FIG. 1 PRIOR ART
FIG. 1 is a perspective view of a conventional pack.

The conventional pack 1 shown in FIG. 1 comprises a tray-like rectangular lower part 4 and a corresponding upper part 3. The lower part 4 and the upper part 3 are joined together by opposite side walls 5, 5*a*. The front end wall 8 and the rear end wall 9 comprise a central opening 20 extending over the entire width through which the articles 2 accommodated in the pack can be seen. The two side walls 5, 5*a* are additionally provided with perforated lines 11, 11*a* which extend parallel to the lower part 4. By tearing along the perforated lines 11, 11*a* (of which only the perforated line in the side wall 5 is visible), the upper part 3 with that part of the side walls 5, 5*a* situated thereon can be lifted off the lower part 4 so that the articles 2 are completely visible.

Figure 2:
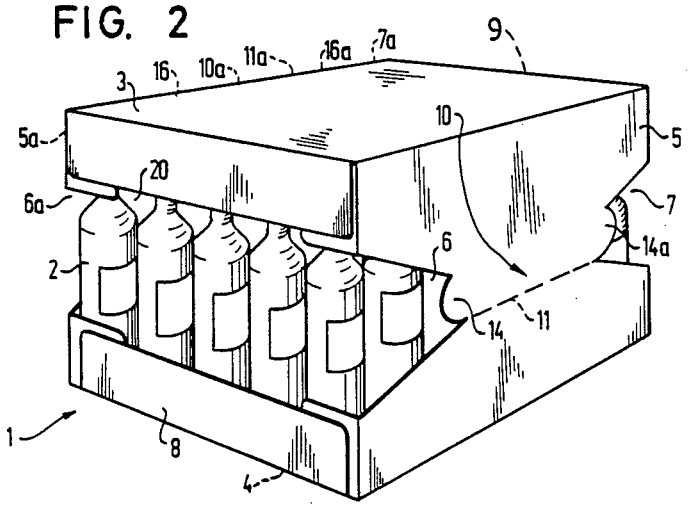
FIG. 2 is a perspective view of a pack according to the invention.

The pack according to the invention shown in FIG. 2 differs from the conventional pack shown in FIG. 1 in that each of the two side walls 5, 5*a* is provided with two tapering openings 6, 7, 6*a*, 7*a*, of which only the openings 6, 7 in the side wall 5 are visible in FIG. 2. The two openings 6*a*, 7*a* in the side wall 5*a* are identical in shape with the openings 6, 7 in the side wall 5. A weakened wall member 10 extends between the two openings 6, 7. At either end, the wall member 10 comprises tongues 14, 14*a* projecting into the openings 6, 7. Here, the perforation line 11 extends through one of the two narrowest points of the wall member 10.

Thus, the pack according to the present invention, as illustrated in FIG. 2, provides for a plurality of elongate articles in FIG. 2, provides for a plurality of elongate articles to be arranged in the pack such that the elongate sides of the articles, i.e, the base and top of the articles between the two ends of the articles, are parallel to one another in a form of a rectangular block and may be seen from four sides of the pack. The upper part and lower part of the pack each have a form of a rectangular tray having a base portion 4 and two opposing tray wall portions 8, 9 extending from two opposing tray base edges for covering one end of the block of articles. The pack also has two opposing sidewalls 5, 5*a*, extending from two tray base edges adjacent the opposing tray wall portions 8, 9. EAch sidewall includes a weakened wall member 10, 10*a*, and connects opposing sides of the upper part 3 and the lower part 4. The opposing tray walls 8, 9 adjacent the connecting sidewalls 5, 5*a* define a first pair of opposed openings through which the articles may be seen. The connecting sidewalls 5, 5*a* and weakened wall members 10, 10*a* are configured to define openings which are adjacent the first pair of opposed openings and which are separated by the weakened wall members such that the articles may be seen from four sides of the pack.

I claim:

1. A pack for a plurality of elongate articles arranged such that elongate sides of the articles between two ends of the articles are parallel to one another in a form of a rectangular block comprising an upper part and a lower part each having a form of a rectangular tray having a base portion and two opposing tray wall portions extending from two opposing tray base edges for covering one end of the block of articles and further comprising two opposing sidewalls extending from two opposing tray base edges adjacent the opposing tray wall portions, each sidewall having a weakened wall member, which connect the upper part and the lower part such that the opposing tray wall portions define a first pair of opposed openings through which the articles may be seen and such that the two opposing connecting sidewalls and weakened wall members are configured to define openings which are adjacent the first pair of opposed openings and which are separated by the weakened wall members such that the articles may be seen from four sides of the pack.

2. A pack according to claim 1, wherein each connecting sidewall is tapered from a point corresponding with the edge of each tray wall portion towards the weakened wall member.

3. A pack according to claim 1 or 2 wherein the weakened wall members have tongues projecting into the openings adjacent the wall members.

4. A pack according to claim 1 or 2 wherein the weakened walls have a perforated line which extends substantially parallel to the bases of the upper part and lower part.

5. A pack according to claim 3 wherein the weakened walls have a perforated line which extends substantially parallel to the bases of the upper part and lower part.

* * * * *